US008616544B2

(12) United States Patent
Katayama et al.

(10) Patent No.: US 8,616,544 B2
(45) Date of Patent: Dec. 31, 2013

(54) DOCUMENT FEEDER, DOCUMENT READER, AND IMAGE FORMING APPARATUS WITH IMPROVED ACCURACY OF DOCUMENT SKEW CORRECTION

(71) Applicants: Yoshiki Katayama, Tokorozawa (JP); Hitoshi Asano, Toyokawa (JP); Masayuki Watanabe, Fuchu (JP); Yukinobu Iguchi, Hamamatsu (JP); Takashi Watanabe, Toyokawa (JP); Masahiro Nonoyama, Toyokawa (JP)

(72) Inventors: Yoshiki Katayama, Tokorozawa (JP); Hitoshi Asano, Toyokawa (JP); Masayuki Watanabe, Fuchu (JP); Yukinobu Iguchi, Hamamatsu (JP); Takashi Watanabe, Toyokawa (JP); Masahiro Nonoyama, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/855,005

(22) Filed: Apr. 2, 2013

(65) Prior Publication Data

US 2013/0256978 A1 Oct. 3, 2013

(30) Foreign Application Priority Data

Apr. 2, 2012 (JP) ..... 2012-084106

(51) Int. Cl.
*B65H 3/06* (2006.01)

(52) U.S. Cl.
USPC ..... 271/109

(58) Field of Classification Search
USPC ..... 271/109, 119, 272
See application file for complete search history.

(56) References Cited

U.S. PATENT DOCUMENTS

| | | | | |
|---|---|---|---|---|
| 4,188,025 | A * | 2/1980 | Gusfafson et al. | 271/314 |
| 5,795,087 | A * | 8/1998 | Brower et al. | 271/125 |
| 6,190,070 | B1 * | 2/2001 | Urban et al. | 271/188 |
| 6,193,232 | B1 * | 2/2001 | Regimbal et al. | 271/272 |
| 7,416,182 | B2 * | 8/2008 | Nishida et al. | 271/228 |
| 7,798,482 | B2 * | 9/2010 | Koga et al. | 271/117 |
| 8,360,414 | B2 * | 1/2013 | Lo et al. | 271/109 |
| 2006/0070840 | A1 * | 4/2006 | Hayashi et al. | 271/226 |
| 2010/0219581 | A1 * | 9/2010 | Yamada | 271/273 |

FOREIGN PATENT DOCUMENTS

| | | | | |
|---|---|---|---|---|
| JP | 01202468 | A * | 8/1989 | B41J 11/02 |
| JP | 2000-078348 | A | 3/2000 | |
| JP | 2005-330084 | A | 12/2005 | |
| JP | 2006-184488 | A | 7/2006 | |
| JP | 2009-292598 | A | 12/2009 | |
| JP | 2010-184770 | A | 8/2010 | |

* cited by examiner

*Primary Examiner* — Jeremy R Severson
(74) *Attorney, Agent, or Firm* — Buchanan Ingersoll & Rooney PC

(57) ABSTRACT

A document feeder feeds document sheets one by one from a stack on a tray by pressing one or more pick-up rollers against an uppermost document sheet and guiding one widthwise edge of the document sheet. The width direction is perpendicular to a document transport direction. The document feeder includes: a document size obtainer that obtains size information indicating a width of the document sheet; and a center-of-contact shifting mechanism that shifts a center of contact of each pick-up roller along an axial direction of the pick-up roller according to the obtained size information. The center of contact is a central point of an area where the pick-up roller is in contact with the document sheet. Each pick-up roller is in a barrel shape. The center-of-contact shifting mechanism shifts the center of contact of each pick-up roller by axially tilting the pick-up roller relative to the document surface.

8 Claims, 10 Drawing Sheets

FIG. 9

220

| 221 Document width (mm) (Vertical orientation) | 222 First pick-up roller | | 223 | 224 Second pick-up roller | | 225 |
|---|---|---|---|---|---|---|
| | Position | Rotational speed | | Position | Rotational speed | |
| 231 148 (A5) | End A downward | Second speed | | Horizontal | Suspend | |
| 232 182 (B5) | Horizontal | First speed | | Horizontal | Suspend | |
| 233 210 (A4) | End B downward | Second speed | | Horizontal | Suspend | |
| 234 257 (B4) | End A downward | Second speed | | End C downward | Second speed | |
| 235 297 (A3) | Horizontal | First speed | | Horizontal | First speed | |

DOCUMENT FEEDER, DOCUMENT READER, AND IMAGE FORMING APPARATUS WITH IMPROVED ACCURACY OF DOCUMENT SKEW CORRECTION

This application is based on an application No. 2012-084106 filed in Japan, the contents of which are hereby incorporated by reference.

BACKGROUND OF THE INVENTION (1) Field of the Invention

The present invention relates to a document feeder and also to a document reader and an image forming apparatus each having the document reader.

(2) Description of the Related Art

Many image forming apparatuses, such as copiers, are equipped with a document feeder that picks up a document sheet placed on a document tray with pick-up rollers, transports the document sheet to an image reading position, and ejects the document sheet onto a document output tray.

Assuming that a stack of document sheets contain different sizes of sheets, some document feeders are configured to transport each document sheet in a so-called "one-edge positioning" manner according to which each document sheet is transported while one edge of the document sheet in a width direction is guided along a guide plate. With such document feeders, it is inevitable that the pick-up roller is pressed against a document sheet at a position deviated from the center of the width (hereinafter, the center of the width may also be referred to as "widthwise center") when advance the document sheet.

When a document sheet is pulled by pressing the pick-up roller against the document sheet at a position deviated from the widthwise center, it often happens that a turning moment is exerted on the document sheet and thus the document sheet is often skewed.

In general, a document feeder is provided with a pair of registration rollers located downstream from the pick-up roller for skew correction. However, if the skew occurred at the time of pulling the document sheet is too large, the pair of registration rollers may not be able to completely correct the skew.

In view of the above, there is a demand for such document feeders that minimize skew occurring when the pick-up roller pulls a document sheet.

Although relating to the feeding of recording sheets from a paper feed cassette in an image forming apparatus, Japanese Patent Application No. 2009-292598 (hereinafter, "Patent Literature 1") suggests a separator mechanism located downstream in the paper feed direction to correct skew of the recording sheet being fed.

The separator mechanism is formed from a cylindrical paper-feed roller and a cylindrical separation roller. The paper-feed roller is driven to rotate, and the cylindrical separation roller is applied with a constant load torque and pressed against the paper-feed roller. According to Patent Literature 1, the rotation axis of the paper-feed roller is tilted relative to the rotation axis of the separation roller by a predetermined angle. As a result of the tilting, the position on the paper-feed roller at which the separation roller makes contact shifts along the direction of the rotation axis, so that skew correction is made.

In the manner described above, by applying the structure of tilting the rotation axis of the roller to the pick-up roller of the document feeder, the position on a document sheet at which the pick-up roller makes contact is ensured to be closer to the widthwise center of the document sheet, which is considered effective to suppress occurrence of skew.

Unfortunately, however, the following should be noted with respect to the image forming apparatus described in Patent Literature 1. That is, when the paper-feed roller and the separation roller are axially in parallel, the respective rollers are pressed against each other uniformly across the width, which means that the nip pressure is maintained at a predetermined level. However, when the paper-feed roller is tilted, only a limited portion of the paper-feed roller near the tilted edge makes contact with the circumferential surface of the separation roller, which means that the nip pressure increases locally and significantly.

For this reason, if the rotation shaft of the pick-up roller is made to tilt by simply applying the structure of Patent Literature 1 to the pick-up roller, the following problem arises. That is, the pressure at a portion of a document sheet pressed by the pick-up roller increases locally, which leads to an increase in friction between the uppermost document sheet and the document sheet below the uppermost document sheet. In this manner, a substantial transport force is applied also to one or more document sheets below the uppermost document sheet, which results in that multiple document sheets are fed at a time (multi-feed).

Generally, a pair of separation rollers is provided at a location downstream from the pick-up roller. Yet, the separation ability of the rollers is limited. When too many sheets are fed at a time, the separation rollers alone cannot reliably separate a single document sheet from the rest.

SUMMARY OF THE INVENTION

The present invention has been made in view of the above problems and aims to provide a document feeder, a document reader, and an image forming apparatus each of which is capable of preventing multi-feed from occurring at the time when the pick-up roller pulls a document sheet and also capable of minimizing occurrence of skew.

In order to achieve the above aim, a first aspect of the present invention provides a document feeder for feeding document sheets one at a time from a stack on a tray by pressing one or more pick-up rollers against an uppermost document sheet and guiding one edge of the document sheet. The one edge refers to one of two edges in a width direction perpendicular to a document transport direction. The document feeder includes: a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet. Each pick-up roller is in a barrel shape. The center-of-contact shifting mechanism shifts the center of contact of each pick-up roller by axially tilting the pick-up roller relative to a surface of the document sheet.

In order to achieve the above aim, a second aspect of the present invention provides a document reader including a document feeder and reading document sheets fed by the document feeder one at a time. The document feeder feeds document sheets one at a time from a stack on a tray by pressing one or more pick-up rollers against an uppermost document sheet and guides one edge of the document sheet, the one edge being one of two edges in a width direction. The document feeder includes: a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet. Each pick-up roller is in a barrel shape. The center-of-contact shifting mechanism shifts the center of contact of each pick-up roller by axially tilting the pick-up roller relative to a surface of the document sheet.

In order to achieve the above aim, a third aspect of the present invention provides an image forming apparatus including: a document feeder that feeds document sheets one at a time from a stack on a tray by pressing one or more pick-up rollers against an uppermost document sheet and guides one edge of the document sheet, the one edge being one of two edges in a width direction perpendicular to a document transport direction; and a document reader that reads document sheets fed by the document feeder one at a time. The document feeder includes: a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet. Each pick-up roller is in a barrel shape. The center-of-contact shifting mechanism shifts the center of contact of each pick-up roller by axially tilting the pick-up roller relative to a surface of the document sheet.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 9 shows the contents of a control table used in the document pick-up process.

DESCRIPTION OF THE PREFERRED EMBODIMENTS

With reference to the accompanying drawings, the following describes an embodiment of a document feeder according to the present invention, by way of an example in which the document feeder is applied to a copier.

(1) Overall Structure of Copier

Figure 1:
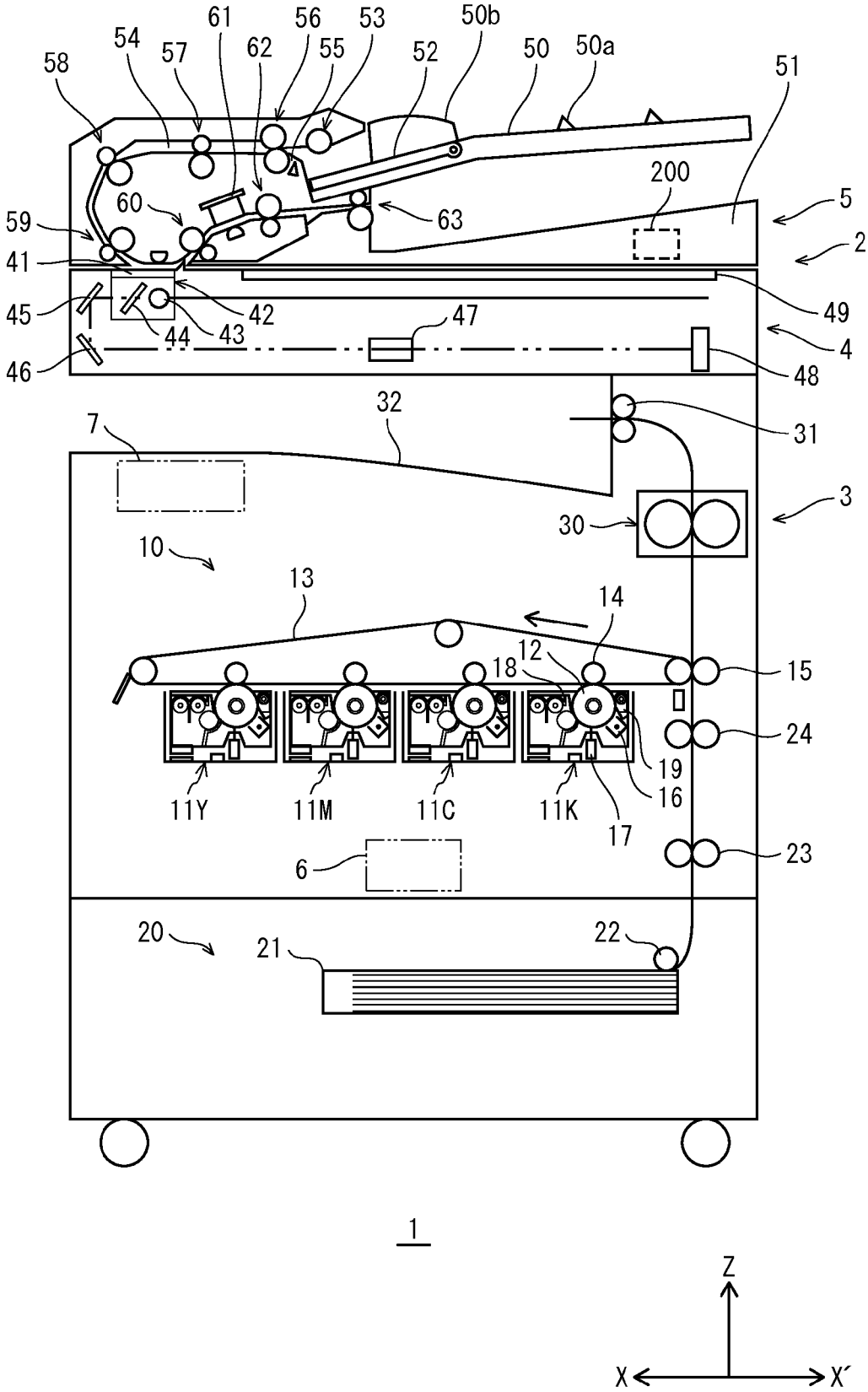
FIG. 1 is a schematic sectional view showing the overall structure of a copier provided with a document feeder according to an embodiment.

FIG. 1 is a schematic sectional view showing the overall structure of a copier according to the embodiment.

As shown in the figure, the copier 1 is roughly composed of an image reader unit 2 for reading a document image and a printer unit 3 for printing the read image onto a recording sheet.

(1-1) Printer Unit

The printer unit 3 includes an image processor 10, a paper feeder 20, a fuser 30, and a controller 6.

The paper feeder 20 includes a paper tray 21, a pick-up roller 22, a pair of separation rollers 23, a pair of timing rollers 24, and so on. Note that the term "paper" used in this specification generally refers to recording sheets, which are not limited to sheets of paper.

The paper tray 21 is for loading recording sheets.

The pick-up roller 22 makes contact with the top surface of the uppermost recording sheet in the stack of recording sheets stacked in the paper tray 21, thereby to feed recording sheets one by one onto the paper transport path.

Of the pair of separation rollers 23, one is a driving roller and the other is a driven roller. The two rollers in the pair are in contact against each other to foam a separation nip therebetween. A torque limiter is attached to the driven roller to apply a force to the recording sheet in the reverse direction of the paper transport direction.

With this arrangement, if a recording sheet is pulled together with one or more extra recording sheets, those extra recording sheets are pushed back and separated from the single recording sheet.

The pair of timing rollers 24 sends the recording sheet to a downstream side according to the timing instructed by the controller 6.

As shown in the figure, the image processor 10 includes image creating units 11Y, 11M, 11C, and 11 K respectively corresponding to the colors Y, M, C, and K, and also includes first transfer rollers 14 each located to face a photoconductive drum disposed in a corresponding one of the image creating units, an intermediate transfer belt 13, a second transfer roller 15 and so on.

As also shown in the figure, the image creating units 11Y, 11M, 11C, and 11K are disposed in order at regularly spaced intervals along the intermediate transfer belt 13.

The image creating unit 11K includes the photosensitive drum 12 and also includes a charger 16, an exposure 17, a developer 18, and a cleaner 19 disposed about the photosensitive drum 12.

Each of the other image creating units 11Y, 11M, and 11C is basically identical in structure with the image creating unit 11K, so that no further description is given here.

The exposure 17 includes a light emitting element typified by a laser diode, and a lens. The exposure 17 receives a drive signal that is generated by the controller 6 based on image data acquired from an external source via, for example, LAN or acquired by the image reader unit 2 reading a document image. According to the drive signal, the exposure 17 emits a laser beam to scan the photosensitive drum 12 in the main scanning direction.

Before the laser beam exposure, the photosensitive drum 12 is cleaned by the cleaner 19 to remove residual toner from the surface, irradiated with light from a non-illustrated eraser lamp for diselectrification, and uniformly charged by the charger 16. In the state being uniformly charged, the photosensitive drum 12 is scanned by the laser beam so that an electrostatic latent image is formed on the surface of the photosensitive drum 12.

The electrostatic latent images on the respective photosensitive drums 12 are developed by the developers 18 of the corresponding colors, so that toner images in the respective colors of Y, M, C, and K are formed on the surfaces of the respective photosensitive drums 12.

The image creation processes for the images in the respective colors are sequentially carried out with appropriately adjusted timing, so that the toner images are transferred precisely to the same position on the surface of the intermediate transfer belt 13. By the action of the electrostatic force imposed by the first transfer rollers 14, the toner images of the respective colors are sequentially transferred onto the intermediate transfer belt 11 to form a full color toner image.

The toner images of the respective colors layered on the intermediate transfer belt 13 are then carried to a second transfer position as a result that the intermediate transfer belt 11 runs.

In the meantime, the paper feeder 20 feeds a recording sheet via the pair of timing rollers 24 in timed relation with the advancing of the intermediate transfer belt 13. Therefore, by the action of the electrostatic force resulting from voltage applied to the second transfer roller 15, the second transfer is carried out at the second transfer position, so that toner images on the intermediate transfer belt 13 are transferred to the recording sheet.

The recording sheet having passed the second transfer position is carried to the fuser 30 where heat and pressure is applied to fix the toner images onto the recording sheet. The recording sheet then passes between a pair of ejection rollers 31 to be ejected onto an exit tray 32.

The controller 6 controls overall operations of the printer unit 3 and the image reader unit 2 of the copier 1.

The printer unit 3 is provided with an operation panel 7 that includes a ten-key pad and a touch panel to receive user operations and also to present information to the user.

(1-2) Image Reader Unit

Next, the image reader unit 2 is described.

The image reader unit 2 is capable of reading document images in both a sheet-through mode which uses a fixed optical system and a scanner-moving mode which uses a moving optical system.

In the sheet-through mode, a document image is read by moving the document sheet while the optical system (read position) is kept static (fixed).

In the scanner-moving mode, a document image is read by moving a mirror relatively to the document sheet placed on the platen glass, thereby to direct light reflected from the document surface to a CCD line sensor.

The image reader unit 2 is provided with an automatic document feed unit 5 and an image reader unit 4. The automatic document feed unit 5 is for enabling reading in the sheet-through method, and the image reader unit 4 is for enabling reading a document image.

The image reader unit 4 can read a document image in both the sheet-through mode and the scanner-moving mode.

(1-2-1) Image Reader Unit

In the sheet-through mode, the image reader unit 4 moves the scanner 42 to a location below a reading glass 41 for the sheet-through mode (i.e., to a sheet-through position).

When a document sheet passes over the upper surface of the reading glass 41, the document sheet is irradiated with light from a lamp 43 of the scanner 42 that remains stationary at the sheet-through position.

Light reflected from the document surface is changed its optical path by a first mirror 44, a second mirror 45, and a third mirror 46 and then passes through a collective lens 47 to form an image on the photo-receiving surface of a CCD line sensor 48.

In the scanner-moving mode, on the other hand, the automatic document feed unit 5 is lifted open and a document sheet is manually placed on a glass 49 for a manual mode. In this case, the scanner 42 travels back to its original position after moving in the right direction in FIG. 1.

At this time, the second mirror 45 and the third mirror 46 travel together in the same direction and at half the speed that the scanner 42 travels. As a result, the distance from the document surface to the collective lens 47 (i.e., optical path) is kept constant at all times and light reflected from the document sheet duly forms an image on the photo-receiving surface of the CCD line sensor 48.

Note that the scanner 42 as well as the second mirror 45 and the third mirror 46 is driven by a power transmission mechanism (not shown) having a scan motor (not shown) as the power source.

(1-2-2) Automatic Document Feed Unit

The automatic document feed unit 5 separates one document sheet at a time from the stack of document sheets in a document feed tray 50, performs skew correction, and feeds the document sheet to pass over the reading glass 41 for the sheet-through mode and finally to a document output tray 51.

Figure 2:
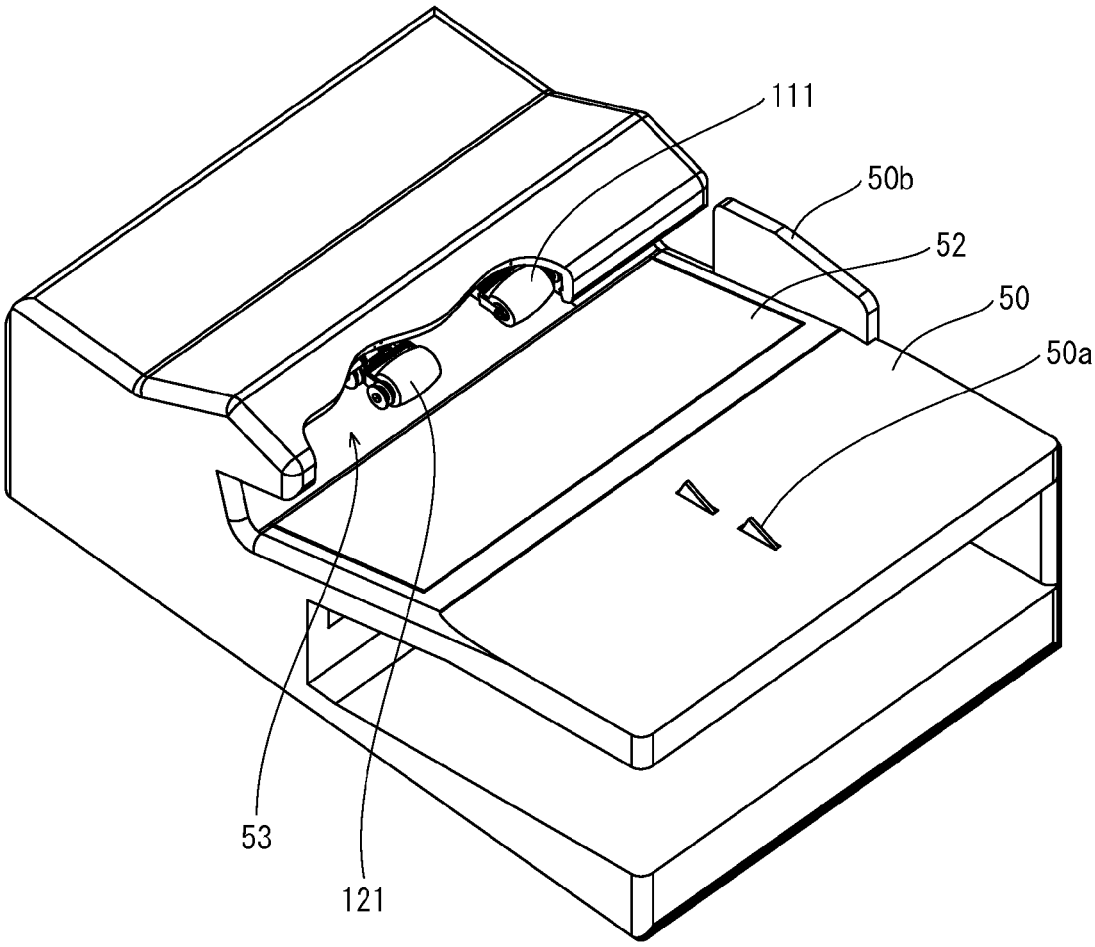
FIG. 2 is a partially cutaway perspective view of the document feeder.

FIG. 2 is a partially cutaway perspective view of the automatic document feed unit 5 of the copier 1.

The automatic document feed unit 5 employs a so-called "one-edge positing" manner according to which a document sheet is transported while one edge of the document sheet in a width direction is guided along a guide plate 50*b*.

The automatic document feed unit 5 has document size sensors 50*a* known in the art. Each document size sensor 50*a* has an actuator of a triangle shape with one corner projecting upward from the surface, of the document feed tray 50, for placing a document sheet. When a document sheet is placed on the document feed tray 50, one or both of the actuators are pressed down, thereby the sensors 50*a* detects the length of the document sheet placed.

The document sheets stacked in the document feed tray 50 are lifted along their leading edges when a lift plate 52 is tilted up by a cam mechanism, which is not shown.

Disposed at a location upward from the leading edge of the lift plate 52 is a pick-up mechanism 53 that includes a first pick-up roller 111 and a second pick-up roller 121. As the leading edges of the document sheets are lifted, the uppermost document sheet comes into contact with the first pick-up roller 111 and the second pick-up roller 121 and thus is pulled into a document transport path 54.

As shown in the figure, both the first pick-up roller 111 and the second pick-up roller 121 are in a barrel shape.

The pick-up mechanism 53 is configured to tilt the rotation axes of the first pick-up roller 111 and the second pick-up roller 121 according to the width of the document sheet to be fed (the size that measures in a direction perpendicular to the document transport direction), thereby to prevent occurrence of skew when pulling the document sheet onto the transport path 54 (see FIG. 1). Details are described later.

Referring back to FIG. 1, a document width detection sensor 55 is disposed downstream in the document transport direction (hereinafter, the terms "downstream" and "upstream" refer to the downstream direction and the upstream direction along the document transport path) from the pick-up mechanism 53.

By the separation nip formed between the pair of separation rollers 56, namely a driving roller that rotates on a driver not shown in the figure, and a driven roller that is rotated as the driving roller rotates under load imposed by a torque limiter, for example, it is ensured that only a single document sheet is separated from the rest of document sheets if any. Then, the single document sheet is forwarded to pass through the nip formed between the pair of intermediate rollers 57 and then carried to a pair of registration rollers 58.

At this time, the pair of registration rollers 58 is at a standstill, so that the leading edge of the document sheet is pressed against the nip formed between the registration rollers 58, causing the document sheet to be bowed at a portion near the leading edge. As a result, inclination of the leading edge is corrected. Afterwards, the pair of registration rollers 58 is started to rotate in a predetermined timed relation in order to forward the document sheet. In this way, skew correction is made.

The document sheet after the skew correction is then carried to a pair of pre-reading rollers 59 disposed downstream from the pair of registration rollers 58.

The pair of pre-reading rollers 59 is disposed upstream from the reading glass 41 for the sheet-through mode.

The document sheet forwarded by the pair of registration rollers 58 is forwarded further via the pair of pre-reading rollers 59 in a manner that the document sheet passes over the reading glass 41 for the sheet-through mode in a predetermined timed relationship.

As a result, a first surface (front surface) of the document sheet is read by the image reader unit 4.

Having passed over the reading glass 41, the document sheet is forwarded further by a pair of first post-reading rollers 60 to a rear surface reader unit 61 where the second surface (rear surface) of the document sheet is read in accordance with the user request.

Having passed the rear surface reading unit 61, the document sheet is forwarded further by a pair of second pair of pre-reading rollers 62 and further by a pair of ejection rollers 63 to be ultimately ejected onto the document output tray 51.

This series of operations of transporting a document sheet from the document feed tray 50 to the document output tray 51 are controlled by a controller 200 provided in the automatic document feed unit 5.

(2) Pick-Up Mechanism

Figure 3:
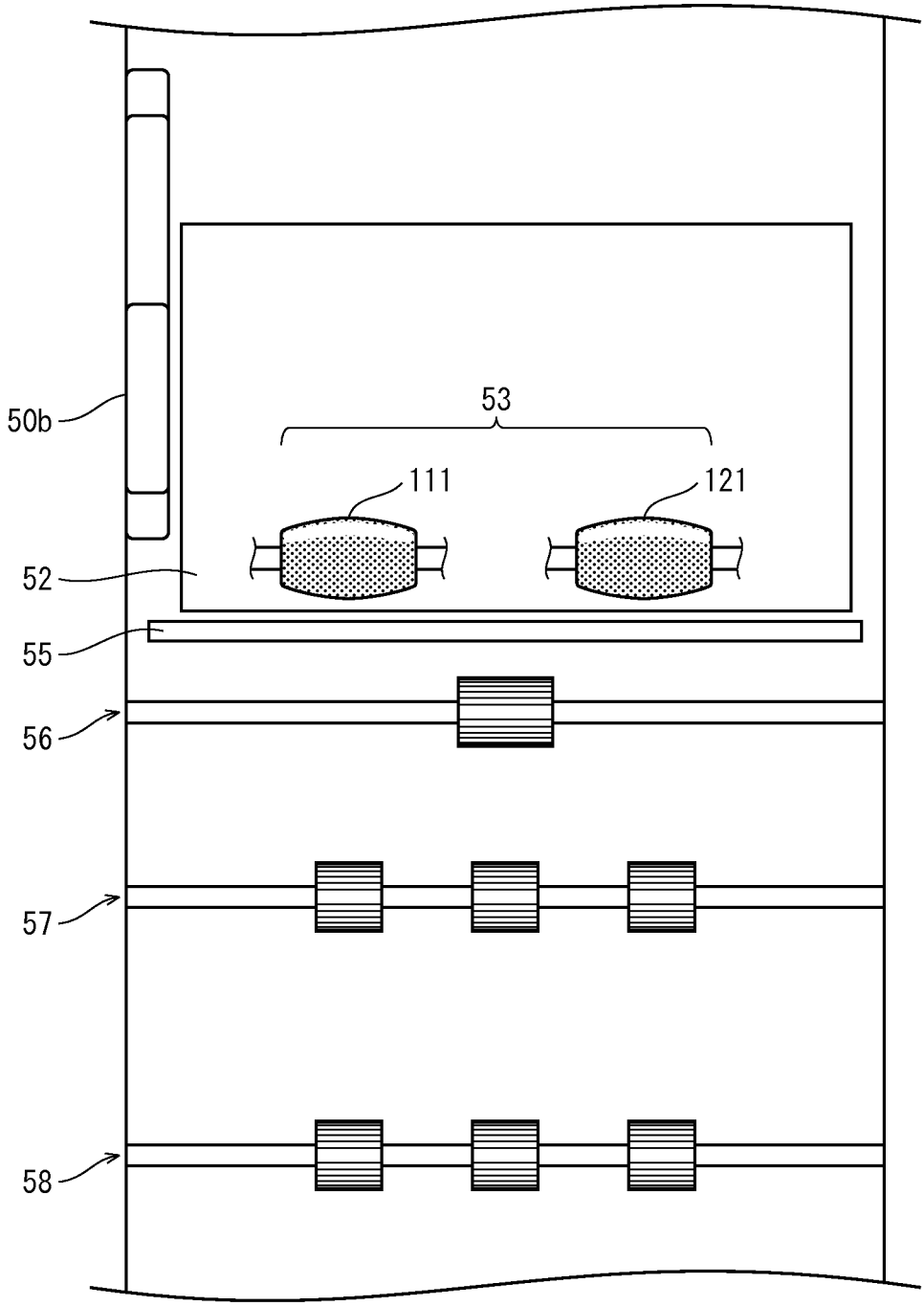
FIG. 3 is a schematic top view of an important part of the document feeder.

FIG. 3 is a view showing a schematic plan view showing the first pick-up roller 111 and the second pick-up roller 121, along with rollers disposed downstream from the first and second pick-up rollers, as seen from above. Note that some of the rollers are paired with another roller, which is disposed below and thus not shown in the figures.

As shown in the figure, the document width detection sensor 55 is disposed at a location immediately downstream from the first pick-up roller 111 and the second pick-up roller 121.

The document width detection sensor 55 is a known reflective light sensor having a plurality of reflective photo-sensors aligned in a direction perpendicular to the document transport direction. The document width detection sensor 55 detects the width of a document sheet by checking whether each photo-sensor detects the document sheet.

It is not necessary that the photo-sensors are disposed densely along the direction perpendicular to the document transport direction. It is sufficient that a sufficient number of photo-sensors are disposed intensively at locations corresponding to the edges of document sheets of the respective sizes. This arrangement allows omission of useless photo-sensors which will not be involved in width detection of any size of document sheets. This omission is effective to prevent increase in manufacturing cost.

At a location downstream from the document width detection sensor 55, the pair of separation rollers 56, the pair of intermediate rollers 57, and the pair of registration rollers 58 are disposed in order along the document transport direction.

Figure 4:
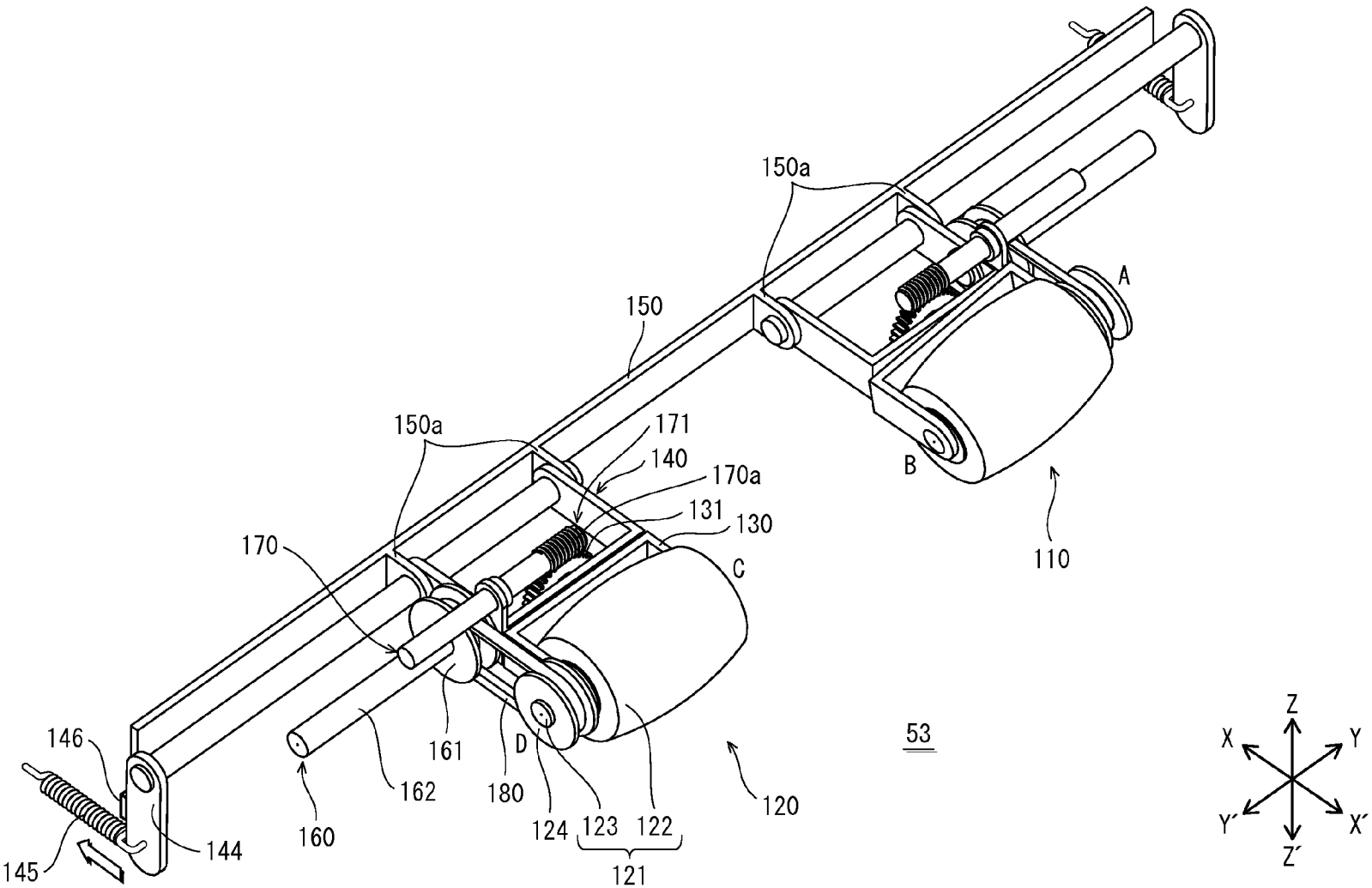
FIG. 4 is a perspective view of a pick-up mechanism of the document feeder.

FIG. 4 is a perspective view showing important part of the pick-up mechanism 53.

As shown in FIG. 4, the pick-up mechanism 53 includes a base member 150, a first pick-up part 110, and a second pick-up part 120.

The base member 150 is an elongated component disposed along the direction perpendicular to the document transport direction (i.e., along Y direction) and is fixed at both ends to the frame (not illustrated) of the automatic document feed unit 5.

The base member 150 has bearings 150*a* and 150*b* which upstand from the surface of the base member 150. The first pick-up part 110 and the second pick-up part 120 are respectively supported on the bearings 150*a* and 150*b* in a manner to be freely pivotable on the respective pivot shafts disposed longitudinally parallel to the Y axis direction.

Note that the first pick-up part 110 and the second pick-up part 120 are identical in structure. Therefore, the following description is given only of the second pick-up part 120 that appears closer toward the front in the figure, and the description of the first pick-up part 110 is omitted.

As shown in FIG. 4, the second pick-up part 120 includes a second pick-up roller 121, a first support member 130 rotatably supporting the second pick-up roller 121, a second support member 140 supporting the first support member 130 pivotally about a pivot shaft 130*a* (see FIG. 5) extending in the X axis direction, and a drive transmission mechanism including a driving pulley 160, a drive belt 180, and a screw gear 170*a*, and so on.

The second pick-up roller 121 has a rotation shaft 123 and a roller body 122 attached to the rotation shaft 123 by means of a one-way clutch. The second pick-up roller 121 is configured to transmit the drive force to the roller body 122 when the rotation shaft 123 is rotated clockwise as seen in the Y direction, and to cause the roller body 122 to rotate easily without load when the rotation shaft 123 is rotated counterclockwise.

The roller body 122 is made from a resilient material having a high friction coefficient, such as robber or resin to produce sufficient friction to pull the uppermost document sheet when the roller body 122 is brought into engagement with the sheet.

In addition, the roller body 122 has a barrel shape which is increasingly smaller in outer diameter from the center toward the edges along the direction of the rotation axis. In one example, the roller body 122 measures 38 mm in length in the direction of the rotation axis.

Note that the barrel shape of roller body 122 in FIG. 4 is slightly exaggerated for purposes of illustration.

The first support member 130 is generally in a squared U-shape having two opposing side plates. The rotation shaft 123 is rotatably supported by the two side plates, and one end of the rotation shaft 123 penetrates through one of the side plates shown closer toward the front. A pulley part 124 is attached to the extended end of the rotation shaft 123. Another pulley part 161 is attached to a first drive shaft 162 that extends in parallel to the rotation shaft 123, and an elastic drive belt 180 is entrained about the pulley parts 124 and 161. By rotatably driving the first drive shaft 162 by a non-illustrated motor, the rotation shaft 123 of the second pick-up roller 121 is driven to rotate.

Figure 5:
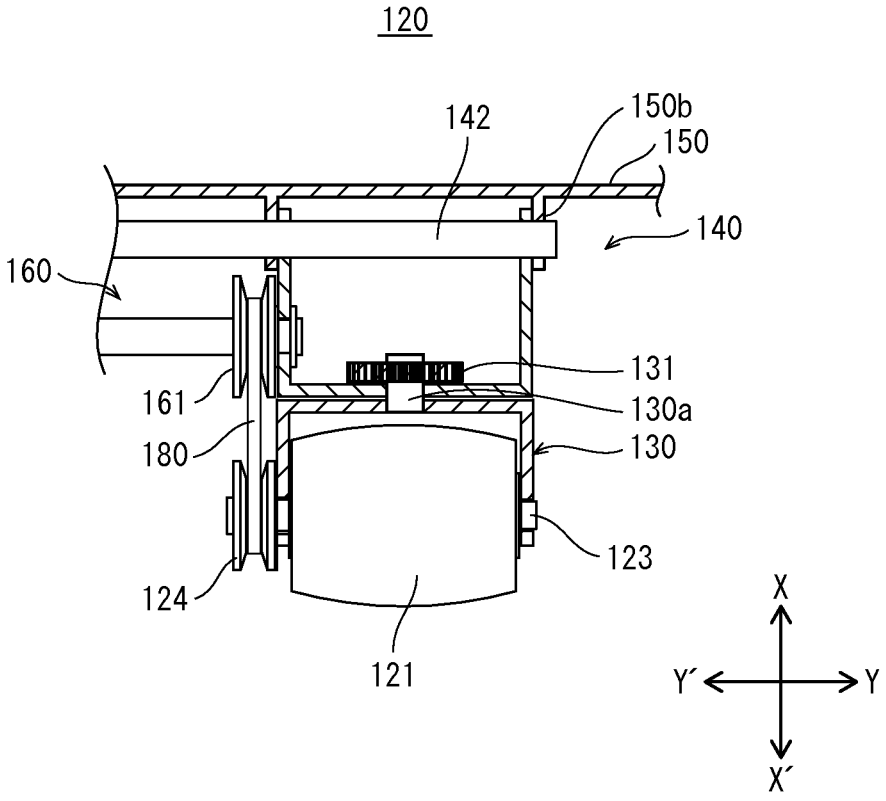
FIG. 5 is a partial cross-sectional view of the pick-up mechanism of the document feeder.

FIG. 5 is a cross-sectional view of the second pick-up part 120, taken along a horizontal plane containing the axis of the rotation shaft 123 of the pick-up roller 121. For the sake of convenience in illustration, the rotation shaft and the rotation body are shown but not in cross section.

As shown in the figure, a second support member 140 is disposed back to back with the first support member 130. The second support member 140 also has a squared U-shape. A fulcrum 130*a* attached centrally to the first support member 130 pivotally supports the first support member 130 relative to the second support member 140.

At one end of the fulcrum 130*a* extending beyond the second support member 140, a helical gear 131 is attached. As shown in FIG. 4, the helical gear 131 meshes with the screw gear 170*a* attached to the second drive shaft 170 that extends in parallel to the Y direction, thereby forming a worm gear 171. By rotatably driving the second drive shaft 170 by a non-illustrated driver, the rotation shaft 123 of the pick-up roller 121 is tilted at an angle determined according to the rotation amount.

The second support member 140 is attached to a shaft 142 at the edges of its opposing side plates. The shaft 142 is supported by the bearing 150*b* of the base member 150. As shown in FIG. 4, a lever 144 is attached to one end of the shaft 142, and the tip of the lever 144 is biased to pull the shaft 142 in the direction to cause the shaft 142 to turn clockwise as seen in the Y direction.

As a consequence, the entire second pick-up part 120 is tilted downward so that the pick-up roller 121 exerts appropriate pressure on the document sheet. The angle at which the lever 144 can rotate clockwise is restricted by a stopper 146 thereby to ensure that the pick-up roller 121 is not moved lower beyond a predetermined level.

The drivers, such as small motors, for the driving pulley 160 and the screw gear 170*a* may be attached to the second support member 140 via a non-illustrated frame, so that the drives pivot together with the second pick-up part 120. Alternatively, the drivers may be attached to the base member 150 or to the main frame of the document feeder. In this case, the first drive shaft 162 and the second drive shaft 170 are belt-driven through elastic drive belts and pulleys or driven through universal joints.

As will be described later, the second support member 140 is configured to swing up and down so that the second support member 140 can be lifted up as the axis of the corresponding one of the pick-up roller is inclined. Therefore, the range within which the second support member 140 swings does not have to be so large. For this reason, the drivers may be secured to the main body of the device, and the second support member is still sufficiently driven by way of belt-driving or universal joints.

As described above, when the second pick-up roller 121 is tilted from the horizontal position, the axis of the pulley part 124 of the second pick-up roller 121 comes to be inclined relative to the axis of the pulley part 161 of the driving pulley 160, which results in that the gap between the respective axes is widen. Yet, since the drive belt 180 is elastic and the inclination is not so large, as well be described later, the torque is duly transmitted to the second pick-up roller 121.

As described above, the second pick-up roller 121 is raised and lowered as the second support member 140 swings. At the same time, the fulcrum 130*a* shown in FIG. 5 is turned clockwise and counterclockwise to axially tilt the second pick-up roller 121 relatively to the document surface (hereinafter, this action of tilting the rotation axis relatively to the document surface is simply referred to as "tilting").

Figure 6A:
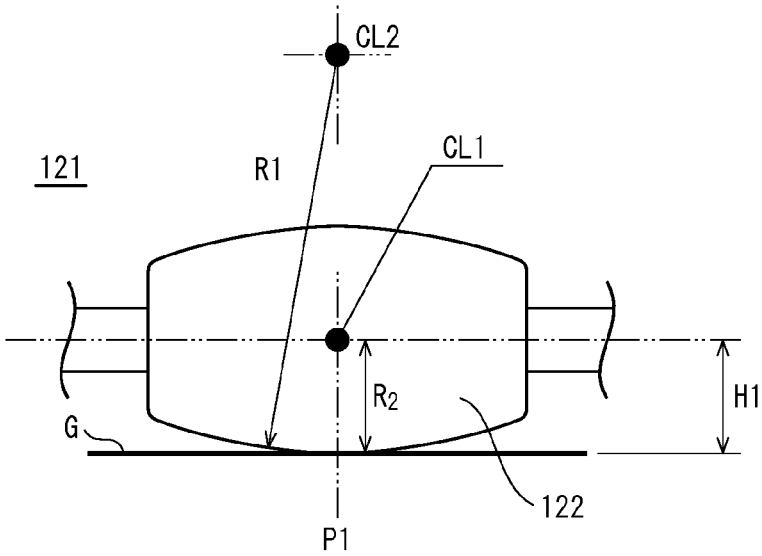
FIGS. 6A and 6B are views showing operations of the pick-up mechanism when a pick-up roller is tilted.
Figure 6B:
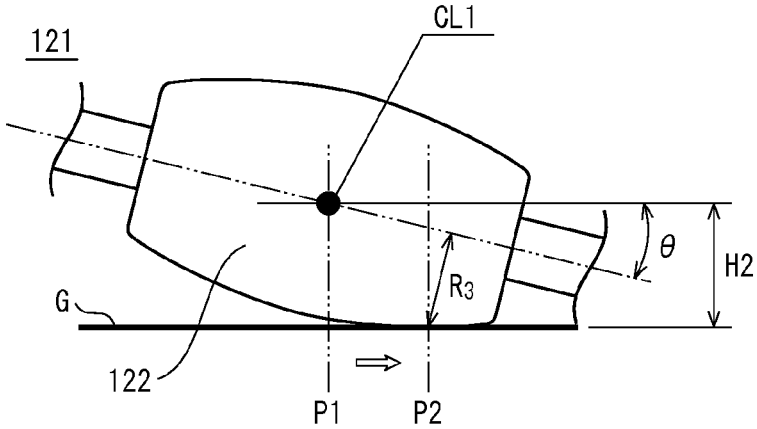

FIG. 6A and FIG. 6B are views showing the action of tilting the second pick-up roller 121. In these figures, the pulley part 124 and some other components are omitted.

FIG. 6A shows the state in which the second pick-up roller 121 is kept horizontal and thus makes contact with the surface of the document sheet G at location P1, which is the center of document sheet G in the rotation axis direction.

In addition, the center CL1, which is the point acting as the center of tilting of the second pick-up roller 121 (i.e., the axis of the fulcrum 130*a*), is away from the surface of the document sheet G by the distance H1.

Here, let R1 denote the curvature of the peripheral surface of the barrel-shaped roller body 122 when the second pick-up roller 121 is seen from the direction perpendicular to the rotation shaft 123, then it is said the value of curvature R1 is set greater than the value of distance H1.

Let R2 denote the rotational radius of the second pick-up roller 121 in the horizontal position to advance the document sheet G, then it is said that the value of rotational radius R2 is equal to the distance H1.

In the present embodiment, the value of R2 is set to 10 mm, for example.

Under the above-noted conditions, when the second pick-up roller 121 is tilted by a predetermined angle, the point corresponding, on the axis, to the center of an area where the second pick-up roller 121 makes contact with the surface of the document sheet G (hereinafter, such a center is referred to as "center of contact") shifts from point P1 to point P2. In addition, the center CL1 of the second pick-up roller 121 shifts to a location that is away from the surface of the document sheet G by the distance H2 (where H2>H1).

That is, when the second pick-up roller 121 is tilted from the horizontal position, the roller body 122 is pressed against the new center of contact P2 to receive force tending to raise the center CL1 upward: As a result, the second support member 140 moves upward so that the second support member 140 can be lifted up.

As a consequence, in addition, the tension spring 145 (see FIG. 4) is pulled to be stretched, thereby increasing the pressure applied by the second pick-up roller 121 onto the surface of the document sheet G Yet, since the roller body 122 is in a barrel shape and has a diminishing diameter toward the ends, the displacement amount of the center CL1 is significantly smaller as compared with the displacement amount that would be resulted by tilting a roller having a conventional cylindrical shape. Therefore, the resulting pressure force will not increase much.

According to the present embodiment, the second pick-up roller 121 is selectively switched among the following three positions in terms of tilting: (1) horizontal position; (2) tilted position at angle θ° relative to the horizontal line; and (3) tilted position at an angle −θ° relative to the horizontal line.

The value of the angle θ° is specifically determined according to the design value of the shift amount of the center of contact, i.e., the distance between the points P1 and P2. In the present embodiment, the maximum angle θ° is set to be 1.2°, which is a relatively small angle.

Figure 6C:
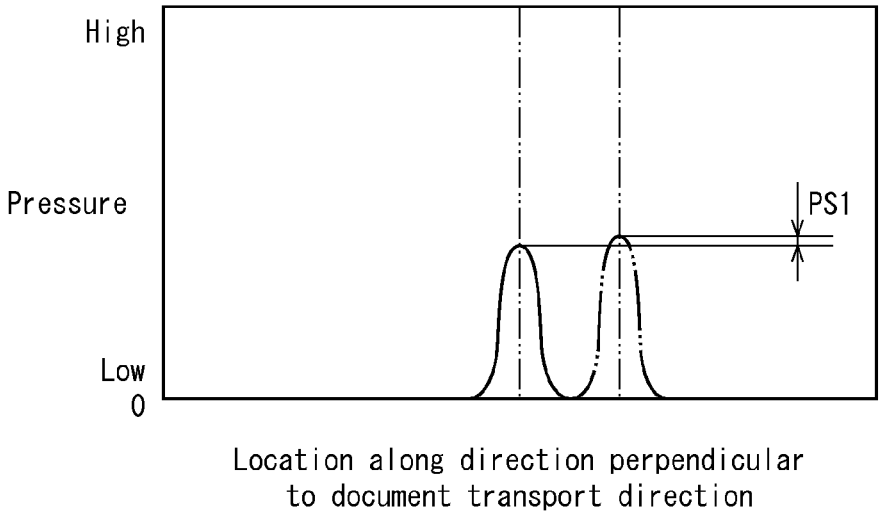
FIG. 6C is a view showing pressure distribution applied by the pick-up roller along the width of a document sheet.

FIG. 6C is a view showing the pressure distribution across the width of the document sheet G.

In the figure, the solid line represents the pressure distribution when the second pick-up roller 121 is in the horizontal position and makes contact with the surface of the document sheet G at point P1 (i.e., the state shown in FIG. 6A).

On the other hand, the two-dot chain line represents the pressure distribution when the second pick-up roller 121 is axially tilted and makes contact with the document sheet G at point P2 (i.e., the state shown in FIG. 6B).

The solid line and the two-dot chain line show the difference PS1 in peak value because the length of the tension spring 145 is changed as a result of the positional shift of the center CL1.

Note that when the pressure exerted at each contact area increases to fall out of the design tolerance limit, the problem of multi-feed occurs.

In order to avoid occurrence of multi-feed, it is desirable to reduce the degree to which the tension spring 145 contracts or expands in response to the positional shift of the center CL11. This is achieved by setting, for example, the natural length of the tension spring 145 relatively long, the axial distance between the rotation shaft 123 of the second pick-up roller 121 and the shaft 142 relatively long, or to set the length of the lever 144 relatively short. With such arrangements, the difference PS1 in peak values resulting from the positional shift of the center CL11 is kept small as much as possible.

Although the description up to this point is directed specifically to the second pick-up roller 121 by way of example to explain the changes in pressure resulting from the tilting, the same description also applies to the first pick-up roller 111.

With the pick-up mechanism 53 having the above-described configuration, the screw gear 170*a* provided for each of the first pick-up part 110 and the second pick-up part 120 is rotated to tilt the first pick-up roller 111 and the second pick-up roller 121. As a result, the center of contact of each pick-up part is shifted in the width direction of the document sheet G Here, let R3 denote the rotational radius of each of the first pick-up roller 111 and the second pick-up roller 121 in the tilt position relative to the horizontal to advance the document sheet G, then it is said that the value of rotational radius R3 is smaller the value of rotational radius R2.

Due to the varying rotation radius, the document transport speed varies as well. In order to compensate for the change in the document transport speed, the automatic document feed unit 5 according to the present embodiment is configured to adjust the respective rotational speeds of the first pick-up roller 111 and of the second pick-up roller 121. Details are described later.

In the pick-up mechanism 53 according to the present embodiment, the value of R3 is set to be smaller than the value of R2 by 0.4 mm.

(3) Control of Document Feed Operations

Figure 7:
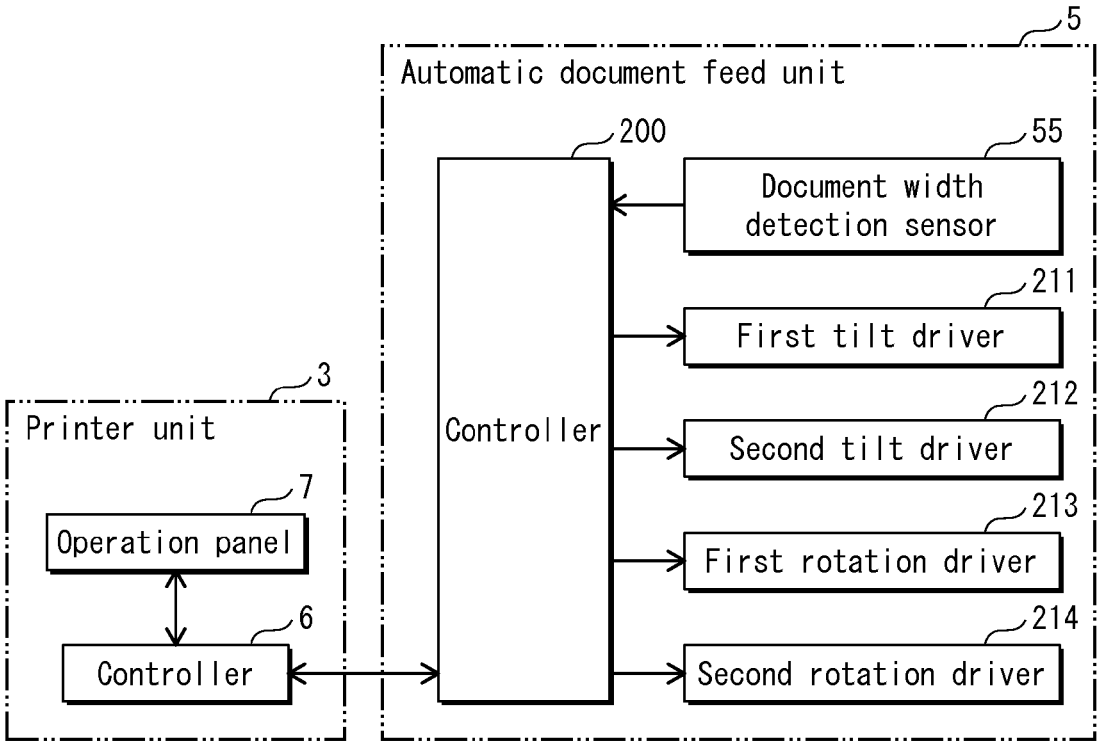
FIG. 7 is a block diagram of major components of a control system of the document feeder.

FIG. 7 is a block diagram of major components of the control system of the automatic document feed unit 5.

A series of operations for transporting document sheets stacked on the document feed tray 50 is controlled by the controller 200 as described above.

According to the present embodiment, the "document pick-up process" executed by the controller 200 differs from conventional control and therefore, the following describes the document pick-up process controlled by the controller 200. The document pick-up process is performed when document sheets of various widths stacked in the document feed tray 50 are to be fed one by one in the so-called "one-edge positing" manner. Further, document pick-up process is performed in order to prevent skew from occurring at the time when the pick-up mechanism 53 pulls a document sheet. Therefore, the following describes the document pick-up process controlled by the controller 200.

The controller 200 is constructed from a CPU, ROM, RAM, EEPROM, and so on.

The controller 200 is connected to: the driver for driving the first pick-up roller 111 and the driver for driving the second pick-up roller 121 (hereinafter, the former driver is referred to as the "first tilt driver 211" and the latter as the "second tilt driver 212"); to the drivers for driving the first pick-up roller 111 and the second pick-up roller 121 (hereinafter, the respective drivers are referred to as the "first rotation driver 211" and the "second rotation driver 212"); to the printer unit 3; and so on.

Each of the first tilt driver 211 and the second tilt driver 212 is a motor of which rotational angle and speed can be controlled, as typified by a stepping motor. The first tilt driver 211 is coupled to the second drive shaft 170 (i.e., to the screw gear 170*a*) which is included in the first pick-up part 110. On the other hand, the second tilt driver 212 is coupled to the second drive shaft 170 (i.e., to the screw gear 170*a*) which is included in the second pick-up part 120.

Similarly to the tilt drivers, each of the first rotation driver 213 and the second rotation driver 214 is a motor of which rotational angle and speed can be controlled, as typified by a stepping motor. The first rotation driver 213 is coupled to the driving pulley 160 of the first pick-up part 110, whereas the second rotation driver 214 is coupled to the driving pulley 160 of the second pick-up part 120.

(3-1) Document Pick-Up Process

Figure 8:
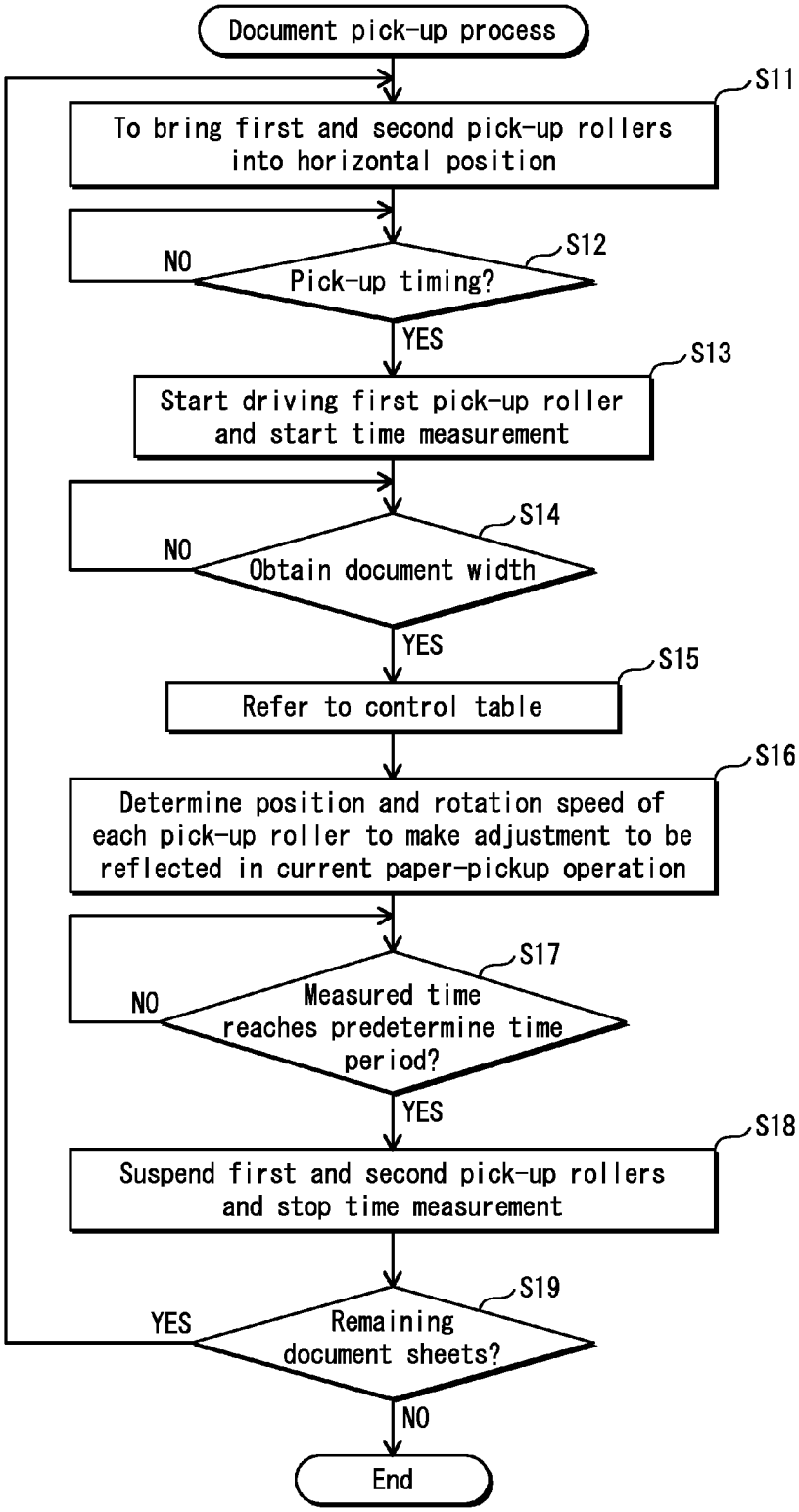
FIG. 8 is a flowchart showing a document pick-up process performed by a controller of the document feeder.

The following describes the document pick-up process performed by the controller 200 according to the present embodiment, with reference to the flowchart shown in FIG. 8.

This control is executed when the controller 200 receives a document read instruction from the controller 6 of the printer unit 3.

First, the controller 200 adjusts the number of drive pulses to be output to the first tilt driver 211 and the second tilt driver 212 to bring the first pick-up roller 111 and the second pick-up roller 121 into the horizontal position as shown in FIG. 6A (Step S11).

Here, a judgment as to whether the first pick-up roller 111 and the second pick-up roller 121 are in the horizontal position is made in the following manner.

For example, the first pick-up roller 111 and the second pick-up roller 121 are brought into the horizontal position in advance, and the count values for the respective pick-up rollers are stored into RAM and initialized to zero.

Then, the count value for each pick-up roller is incremented by one each time a drive pulse is output to turn the corresponding pick-up roller clockwise by a predetermined angle, and is decremented by one each time a drive pulse is output to turn the corresponding pick-up roller counterclockwise. Note that the directions of clockwise and counterclockwise refer to those when the pick-up mechanism 53 is seen from the side in which the document feed tray 50 is located.

In the manner describe above, each count value held in RAM indicates the current angle by which the corresponding pick-up roller is turned relative to the horizontal position. Thus, when the corresponding count value is equal to zero, it is known that the corresponding pick-up roller is in the horizontal position.

Next, the controller 200 waits until the pick-up rollers are brought into the horizontal position and thus become ready to pick up a document sheet (Step S12: NO).

When the pick-up rollers are brought into the state of readiness for picking up a document sheet (Step S12: YES), the controller 200 drives the first rotation driver 213 alone thereby to drive the first pick-up roller 111 alone to pull a document sheet toward the pair of separation rollers 56, and also starts measuring the length of time (Step S13).

The reason for driving the first pick-up roller 111 alone is that the width of the uppermost document sheet is unknown at the start of the pick-up operation because document sheets of various sizes are stacked. The width of a document sheet is detected by forwarding the leading edge of the document sheet to the document width detection sensor 55.

At this time, the document sheet forwarded may be of a large size such as A3 size. In such a case, the document sheet comes into contact with the second pick-up roller 121 as well. Yet, owing to the one-way clutch function, the second pick-up roller 121 passively rotates as the document sheet is forwarded. Therefore, the operation of the first pick-up roller 111 to forward the document sheet is dully carried out without much trouble.

In addition, the document width detection sensor 55 is disposed at a location immediately downstream from the first pick-up roller 111 and the second pick-up roller 121. Therefore, as the document sheet is forwarded in a manner described above, the leading edge of the document sheet soon reaches the document width detection sensor 55 where the width of the document sheet is detected. The detection result is output to the controller 200 and the control for suppressing occurrence of skew is executed in the following manner.

Upon obtaining the document width (Step S14: YES), the controller 200 refers to a control table stored on ROM (Step S15) to determine the position and rotational speed for each of the first pick-up roller 111 and the second pick-up roller 121. Then, the controller 200 immediately adjusts the control of the respective rollers executing the current feed operation (Step S16), thereby suppressing occurrence of skew. Details are described later.

Then, the controller 200 waits until the length of time started to be measured in Step S13 reaches the predetermined time period (Step S17:NO). The predetermined time period is equal to time expected to be taken for the trailing edge of the document sheet being fed to pass the first pick-up roller 111. When the predetermined time period is reached (Step S17: YES), the controller 200 stops transmission of the driving force by causing the first pick-up roller 111 and the second pick-up roller 121 to idle and also stops the time measurement (Step S18).

Next, the controller 200 judges whether there is any document sheet remaining on the document feed tray 50. If there is no more document sheets (Step S19: NO), the controller 200 ends the document pick-up process.

On the other hand, if there is one or more document sheet remaining on the document feed tray 50 (Step S19: YES), the processing goes back to Step S11 to bring the first pick-up roller 111 and the second pick-up roller 121 to the horizontal position.

In one example of the method of judging where or not there is any document sheet remaining, the two document size sensors provided in the document feed tray 50 may be used. If neither of the document size sensors detects a document sheet, it is then judged that there is no document sheet remaining.

(3-2) Control Table

FIG. 9 shows the contents of a control table 220.

The first column of the control table 220 is a document width column 221 storing the widths of document sheets in A5, B5, A4, B4, and A3 sizes in the vertical orientation. With reference to the record matching the document width detected by the document width detection sensor 55, the position and rotational speed for each of the first pick-up roller 111 and the second pick-up roller 121 are obtained.

It is expected that the document width as detected may not match precisely with any of the widths stored in the document width column 221 due to detection errors, for example.

Therefore, the present embodiment allows for a margin of ±7 mm for each width stored in the document width column 221.

The second column of the control table 220 is a position column 222 storing information specifying the position which the first pick-up roller 111 should take for each document width.

The "horizontal" stored in this column means that the first pick-up roller 111 should be placed in the horizontal position, and the "end B downward" indicates that the first pick-up roller 111 should be tilted downwardly to its Y' direction end (i.e., the end B), as shown in FIG. 4.

On the other hand, the "end A downward" means that the first pick-up roller 111 should be tilted downwardly to its Y direction end (i.e., end A).

The first pick-up roller 111 is selectively switched among the three positions. The same description also applies to the second pick-up roller 121.

As shown in FIG. 9, the third column of the control table 220 is a rotational speed column 223 storing information specifying the rotational speed of the first pick-up roller 111 for each document width. The "first speed" in this column means that the first pick-up roller 111 is rotated at the normal rotational speed (in terms of revolutions per unit time) that is in synchronization with the system speed determined for the automatic document feed unit 5 to transport a document sheet.

Note that, as described earlier, when the first pick-up roller 111 is tilted, the rotational radius decreases from R2 to R3 (the same applies to the second pick-up roller 121 as well). Naturally, the transport speed of a document sheet decreases if the rotational speed is kept at the normal speed (see FIG. 6).

The "second speed" refers to the rotational speed that is faster than the first speed so as to compensate for the above-described decrease of the document transport speed resulting from the tilting of the pick-up roller.

That is, let N denote the revolutions per unit time of the first pick-up roller 111 placed in the horizontal position, the revolutions per unit time at the second speed is then given by $N \times (R2/R3)$.

The fourth column of the control table 224 is a position column 224 which stores information specifying the position of the second pick-up roller 121, in a manner similar to the position column 222.

The position column 224 is similar to the position column 222, except that the "end C" and the "end D" refer to the Y direction end and Y' direction end of the second pick-up roller 121, respectively. Other than that, the same description applies and therefore no further description of the position column 222 is given.

The fifth column of the control table 220 is a rotational speed column 225 which stores information specifying the rotational speed of the second pick-up roller 121, in a manner similar to the rotational speed column 223.

The "first speed" and "second speed" indicated in the rotational speed column 225 have the same meaning as those indicated in the rotational speed column 223. In addition, the "suspended" means that the second pick-up roller 121 is idled and thus transmission of the driving force is stopped.

Figure 10:
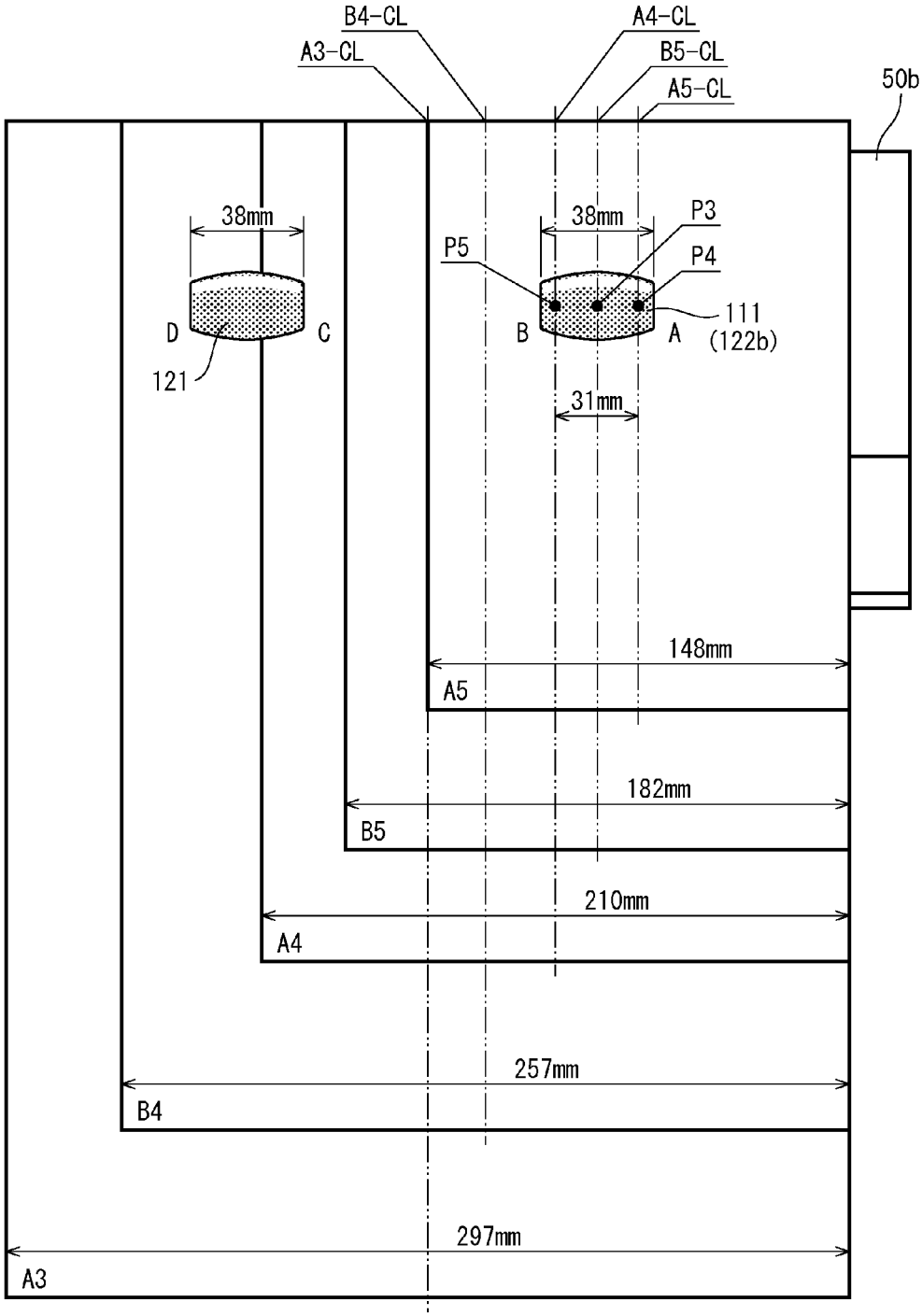
FIG. 10 is a schematic view showing the locations at which the pick-up rollers are located.

FIG. 10 is a schematic view showing the locations at which the first pick-up roller 111 and the second pick-up roller 121 are placed.

In addition, the figure also shows the areas occupied by the document sheets of the respective sizes when the document sheets are placed in the vertical orientation on the document feed tray 50 with one edge engaged against the guide plate 50.

As shown in the figure, the first pick-up roller 111 is located so that the center of contact P3 of the first pick-up roller 111 in the horizontal position falls on the center line B5-CL of a B5 size document sheet in the width direction.

That is, when the first pick-up roller 111 is rotated in this state at the first speed, the force for transporting the document sheet is exerted on the widthwise center of a B5 size document sheet. As a consequence, the document sheet is pulled without a turning moment, so that occurrence of skew is prevented (in the control table 220 shown in FIG. 9, this control corresponds to the second record storing the document width 232, which is the width of a B5 size document sheet).

In addition, the curvature R1 of the outer peripheral surface (see FIG. 6A) as well as the tilt angle θ (see FIG. 6B) of the first pick-up roller 111 is set so that the center of contact P4 of the first pick-up roller 111 that is downwardly tilted to the end A falls on the center line A5-CL of an A5 size document sheet in the width direction.

When the first pick-up roller 111 is rotated in this state at the second speed, the force for transporting the document sheet is exerted on the widthwise center of an A5 size document sheet. As a consequence, the document sheet is pulled without a turning moment, so that occurrence of skew is prevented (in the control table 220 shown in FIG. 9, this control corresponds to the first record storing the document width 231, which is the width of a B5 size document sheet).

In addition, the tilt angle θ of the first pick-up roller 111 is set so that the center of contact P5 of the first pick-up roller 111 downwardly tilted to the end B falls on the center line A4-CL of an A4 size document sheet in the width direction.

When the first pick-up roller 111 is rotated in this state at the second speed, occurrence of skew is prevented for the same reason as that explained for the case where the first pick-up roller 111 is downwardly tilted to the end A (in the control table 220 shown in FIG. 9, this control corresponds to the third record storing the document width 233, which is the width of an AS size document sheet).

On the other hand, the second pick-up roller 121 is located so that the first pick-up roller 111 and the second pick-up roller 121 are in symmetrical relation with respect to an imaginary plane that contains the center line A3-CL of an A3 size document sheet and is perpendicular to the lift plate 52.

When an A3 size document sheet is pulled to the document transport pass, the first pick-up roller 111 and the second pick-up roller 121 located in the above-described manner are both brought into the horizontal position and rotated at the normal speed. As a result, the force for transporting the document sheet is applied at two locations that are in symmetrical relation about the center line A3-CL of an A3 size document sheet. Consequently, the document sheet is pulled without a turning moment, so that occurrence of skew is prevented (in the control table 220 shown in FIG. 9, this control corresponds to the fifth record storing the document width 235, which is the width of an A3 size document sheet).

When a B4 size document sheet is pulled to the document transport pass, the first pick-up roller 111 and the second pick-up roller 121 located in the above-described manner are rotated after downwardly tilted to the end A and to the end C, respectively. As a result, the force for transporting the document is applied at two locations which are not in precisely symmetrical relation about the center line B4-CL of a B4 size document sheet but sufficiently close to the symmetrical relation. Consequently, the document sheet is pulled with little chance of a turning moment, so that occurrence of skew is prevented (in the control table 220 shown in FIG. 9, this control corresponds to the fourth record storing the document width 234, which is the width of a B4 size document sheet).

As described above, the pick-up mechanism 53 of the automatic document feed unit 5 according to the present embodiment is enabled to adjust the tilting of the first pick-up roller 111 and the second pick-up roller 121 individually, thereby changing the center of contact of each pick-up roller with respect to the document width. When a first document sheet is forwarded to the pick-up mechanism 53, the width of that document sheet is immediately detected and an appropriate adjustment is made. As a result of the adjustment, the location at which the first pick-up roller 111 makes contact with the document sheet is shifted toward the widthwise center of the document sheet, or the locations at which the first pick-up roller 111 and the second pick-up roller 121 make contact with the document sheet are shifted to be symmetrical about the widthwise center of the document sheet as much as possible. Consequently, the pick-up mechanism 53 can pull a document sheet to the document transport path while suppressing occurrence of skew.

In addition, since the first pick-up roller 111 as well as the second pick-up roller 121 is in a barrel shape, the document sheet is contacted by the curved surface of the pick-up roller regardless of before or after the tilting. This ensures that the size of the contact area does not change much before and after the tilting, which also means that the pressure applied on the document sheet does not change much. Consequently, occurrence of multi-feed of document sheets is thus suppressed.

<Modifications>

(1) According to the above embodiment, each of the first pick-up roller 111 and the second pick-up roller 121 is configured to be selectively switched among the three positions, namely, the horizontal position and the tilted positions at the angle +θ° or −θ° relative to the horizontal position. Through the positional switching, the center of contact of each pick-up roller is shifted to three different points relatively to the document width. Alternatively, however, each pick-up roller may be switched between two positions, namely, the horizontal position and the tilted position at the angle +θ° relative to the horizontal position. This alternative is particularly applicable in the case where the number of permissible document sizes is relatively small.

In that case, the roller body 122 may have an altered outer shape without forming one end thereof into any particular shape. That is, it is not required that the pick-up roller is axially symmetrical in outer shape.

In the case where the number of permissible document sizes is relatively large, the first pick-up roller 111 and the second pick-up roller 121 may be modified to be axially longer and to provide four or more possible positions that each pick-up roller can take to shift the center of contact into four or more different points relative to the document width.

(2) According to the above embodiment, two pick-up rollers, namely the first pick-up roller 111 and the second pick-up roller 121, are provided. Alternatively, however, a document feeder that can handle up to A4 size document sheets may have one pick-up roller having a barrel shape of a longer width. In such an alternative, by tilting the pick-up roller, the center of contact is duly shifted to a sufficiently desirable location relative to the document width.

(3) According to the above embodiment, when tilted, the first pick-up roller 111 and the second pick-up roller 121 are driven to rotate at the second speed to keep the same document transport speed as that obtained when the respective rollers are in the horizontal position. However, each pick-up roller may be driven to rotate at the first speed even when the roller is tilted, except in a case where only one of the first pick-up roller 111 and the second pick-up roller 121 is driven in the horizontal position and the other in the tilted position (hereinafter, "driving state A").

Under the driving state A, unless the document transport speed of the tilted pick-up roller is made to match the document transport speed of the horizontal pick-up roller, turning moment on the document sheet is produced due to the difference in the speeds at which the document sheet is pulled by the respective rollers. However, under the other driving state, no turning moment results from the difference in document transport speeds.

More specifically, for example, suppose that the first pick-up roller 111 and the second pick-up roller 121 are downwardly tilted to the end A and the end C, respectively (in the control table 220 shown in FIG. 9, this control corresponds to the fourth record storing the document width 234, which is the width of a B4 size document sheet) and the respective rollers are rotated at the first speed. In this case, turning moment on the document sheet is not produced. Similarly, suppose that the first pick-up roller 111 is downwardly tilted to the end A whereas the second pick-up roller 121 is held in the horizontal position (in the control table 220 shown in FIG. 9, this control corresponds to the first record for the width of an AS size document sheet stored in the document width 231) and the respective rollers are rotated at the first speed. In this case, too, turning moment on the document sheet is not produced. It is because the second pick-up roller 121 is not in contact with the uppermost document sheet, rotation of the first pick-up roller 111 at the first speed does not result in turning moment on the document sheet.

Yet, when a document sheet is fed under this state, the document transport speed is slower than usual. Thus, when the leading edge of the document sheet comes to abut against the nip formed between the pair of separation rollers 56, a force tending to pull the leading edge of the document sheet is exerted because the peripheral speed of the pair of separation rollers 56 is relatively faster than that of the first pick-up roller 111. However, due to the action of the one-way clutch built in the first pick-up roller 111, the document sheet is duly pulled without causing substantial back tension.

(4) According to the above embodiment, in addition, that the worm gear that includes the screw gear 170*a* and the helical gear 131 is employed to tilt the first pick-up roller 111 and the second pick-up roller 121. However, this is merely an example and without limitation.

For example, in the case where each of the first pick-up roller 111 and the second pick-up roller 121 is selectively switched between two possible positions, as in the modification (1) above, a driving mechanism such as a solenoid may be employed to change the positions of the respective rollers.

(5) According to the above embodiment, each of the first pick-up roller 111 and the second pick-up roller 121 is driven via the drive belt 180. However, this is merely an example and without limitation.

For example, each of the first pick-up roller 111 and the second pick-up roller 121 may be driven via a universal joint or the like. Alternately, each pick-up roller may be provided with a small built-in motor and driven by the motor.

(6) According to the above embodiment, the operations for transporting document sheets stacked in the document feed tray 50 are controlled by the controller 200 included in the automatic document feed unit 5. Alternatively, however, the control may be carried out by the controller 6 included in the printer unit 3.

(7) According to the above embodiment, the width of a document sheet is detected by the document width detection sensor 55. However, the document width may be manually input by an operator using the operation panel 7, for example. In short; the means for obtaining the document width is not limited to any specific one as long as the document width is duly obtained.

(8) According to the above embodiment, the pick-up mechanism 53 is provided with two pick-up rollers. However, the number of pick-up rollers is not limited to two and the pick-up mechanism 53 may be provided with three or more pick-up rollers.

In such a modification, it is desirable to make adjustments so that one of the pick-up rollers makes contact with a document sheet and at a location closer to the widthwise center of the document sheet or that two or more of the pick-up rollers make contact with a document sheet at locations in symmetrical relation or close to a symmetrical relation about the center line of the document sheet.

(9) According to the above embodiment, an image forming apparatus provided with a document feeder is described by taking a copier as an example. However, the image forming apparatus is not limited to a copier and may be applicable to other image forming apparatuses such as facsimile and the like. In addition, the image forming apparatus is not the only applicable example and other applicable examples include an image reading apparatus having a document reading function only.

In addition, the above described embodiment and modifications may be combined in various ways without departing from the gist of the present invention.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A document feeder for feeding document sheets one at a time from a stack on a tray by pressing one or more pick-up rollers against an uppermost document sheet and guiding one edge of the document sheet, the one edge being one of two edges in a width direction perpendicular to a document transport direction, the document feeder comprising:

a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet, wherein each pick-up roller is in a barrel shape, and the center-of-contact shifting mechanism shifts the center of contact of each pick-up roller by axially tilting the pick-up roller relative to a surface of the document sheet.

2. The document feeder according to claim 1, wherein the pick-up roller comprises a plurality of pick-up rollers, the document feeder further comprises:

a plurality of drivers provided one for each pick-up roller; and a controller that controls each driver to rotate at a speed equal to a peripheral speed of the corresponding pick-up roller at the center of contact.

3. The document feeder according to claim 2, wherein the pick-up roller comprises two pick-up rollers, and an amount of tilt of each pick-up roller relative to the surface of the document sheet is adjusted to cause the center of contact of each pick-up roller to shift closer toward a widthwise center of the document sheet.

4. The document feeder according to claim 3, wherein the two pick-up rollers are disposed to be symmetrical about the widthwise center of the document sheet of a largest permissible size.

5. The document feeder according to claim 1, wherein the pick-up roller comprises a plurality of pick-up rollers, and an amount of tilt of each pick-up roller relative to the surface of the document sheet is determined to make the pick-up rollers all equal in terms of a minimum distance between the center of contact of each pick-up roller and a rotation axis of the pick-up roller.

6. The document feeder according to claim 1, wherein the center-of-contact shifting mechanism shifts the center of contact of each pick-up roller to any of three or more positions along the axial direction.

7. A document reader including a document feeder and reading document sheets fed by the document feeder one at a time, the document feeder feeding document sheets one at a time from a stack on a tray by pressing one or more pick-up rollers against an uppermost document sheet and guiding one edge of the document sheet, the one edge being one of two edges in a width direction, the document feeder comprising:

a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet, wherein each pick-up roller is in a barrel shape, and the center-of-contact shifting mechanism shifts the center of contact of each pick-up roller by axially tilting the pick-up roller relative to a surface of the document sheet.

8. An image forming apparatus comprising:

a document feeder that feeds document sheets one at a time from a stack on a tray by pressing one or more pick-up rollers against an uppermost document sheet and guides one edge of the document sheet, the one edge being one of two edges in a width direction perpendicular to a document transport direction; and a document reader that reads document sheets fed by the document feeder one at a time, wherein the document feeder includes:

a document size obtainer that obtains size information indicating a width of the document sheet; and a center-of-contact shifting mechanism that shifts a center of contact of each pick-up roller along an axial direction of the pick-up roller according to the obtained size information, the center of contact being a central point of an area where the pick-up roller is in contact with the document sheet, wherein each pick-up roller is in a barrel shape, and the center-of-contact shifting mechanism shifts the center of contact of each pick-up roller by axially tilting the pick-up roller relative to a surface of the document sheet.

* * * * *